US005127892A

United States Patent [19]

Sawdon

[11] Patent Number: 5,127,892

[45] Date of Patent: Jul. 7, 1992

[54] THERAPEUTIC FOOT AND LEG EXERCISE DEVICE

[76] Inventor: Floyd Sawdon, 641 E. Aitken Rd., Applegate, Mich. 48401

[21] Appl. No.: 596,337

[22] Filed: Oct. 12, 1990

[51] Int. Cl.[5] ..... A63B 23/10

[52] U.S. Cl. ..... 482/79; 128/25 B

[58] Field of Search ..... 128/25 B; 272/96, 97, 272/94, 146, 143, 119; 36/115, 11.5, 85

[56] References Cited

U.S. PATENT DOCUMENTS

| | | | |
|---|---|---|---|
| 1,509,793 | 9/1924 | Thompson | 272/96 |
| 1,990,970 | 2/1935 | Wood | 272/119 |
| 2,096,500 | 10/1937 | McCahan et al. | 36/11.5 |
| 2,114,790 | 4/1938 | Venables | 272/119 |
| 2,374,730 | 5/1945 | Catlin | 272/96 |
| 4,200,997 | 5/1980 | Scheinhaus et al. | 36/11.5 |
| 4,678,183 | 7/1987 | Skovajsa | 272/97 |
| 4,802,856 | 2/1989 | Olson | 272/97 |
| 4,909,503 | 3/1990 | Olson | 272/97 |
| 4,948,121 | 8/1990 | Haaheim et al. | 272/97 |
| 4,960,276 | 10/1990 | Fever et al. | 272/97 |

FOREIGN PATENT DOCUMENTS

| | | | |
|---|---|---|---|
| 966684 | 10/1950 | France | 36/11.5 |

*Primary Examiner*—Richard J. Apley
*Assistant Examiner*—Lynne Reichard
*Attorney, Agent, or Firm*—John J. Swartz

[57] ABSTRACT

An in situ foot exercise shoe for enhancing the in-place exercise of the foot of a person, particularly the elderly and those afflicted with various abnormalities of the lower extremities which require exercise without actual walking or running. The apparatus constructed according to the present invention comprises a shoe which enhances sliding movement in a to-and-fro path of travel. The shoe includes a planar slide for sliding in a to-and-fro reciprocal path of travel and mechanism for coupling the slide to the underside of the foot. The slide includes a sole having a smooth uninterrupted planar bottom surface for enhancing to-and-fro sliding movement.

13 Claims, 1 Drawing Sheet

THERAPEUTIC FOOT AND LEG EXERCISE DEVICE

BACKGROUND OF THE INVENTION

1. Field of the Invention

This invention relates to exercise apparatus and more particularly to a shoe for enhancing the in-place exercise of a leg and foot.

2. Descriptions of the Prior Art and Objects

Some of the elderly, as well as individuals who have injured or diseased legs and feet, are incapable of walking and yet need exercise to increase blood circulation, maintain strength, and preclude atrophy of the leg and foot muscles. Such individuals may wish to exercise their legs and feet while sitting and conversing or while watching television. It has been found that suitable exercise may be obtained by sliding the feet in a to-and-fro longitudinal path of travel. It frequently occurs, however, that the feet, with or without shoes, are not easily slid on the underlying support surface because of the friction between the feet or shoe and the underlying support surface. Accordingly, it is an object of the present invention to provide a new and novel therapeutic foot exercise shoe which will enhance the to-and-fro sliding movement of a foot on an underlying support surface.

It is another object of the present invention to provide a therapeutic foot exercise shoe which includes a rigid planar slide that is mounted on the underside of a foot and easily slides with the users foot in a to-and-fro path of travel on an underlying support surface.

It is another object of the present invention to provide a new and novel therapeutic shoe of the type described including a new and novel strap for coupling the sole of the shoe to the foot.

It is another object of the present invention to provide a therapeutic foot exercise shoe of the type described including an in-step support member which also functions to preclude relative longitudinal movement of the foot and of the shoe and the foot.

Other objects and advantages of the present invention will become apparent to those of ordinary skill in the art as the description thereof proceeds.

SUMMARY OF THE INVENTION

A therapeutic foot exercise shoe comprising a longitudinally extending rigid planar slide for sliding in a to-and-fro longitudinal path of travel on an underlying support member, and mechanism for coupling the slide to the underside of a foot; the slide includes a sole having an upper foot support surface and a smooth, uninterrupted, planar bottom surface for enhancing the to-and-fro sliding movement.

DESCRIPTION OF THE DRAWINGS

The invention may be more readily understood by referring to the accompanying drawings, in which.

DESCRIPTION OF THE PREFERRED EMBODIMENT

Figure 3:
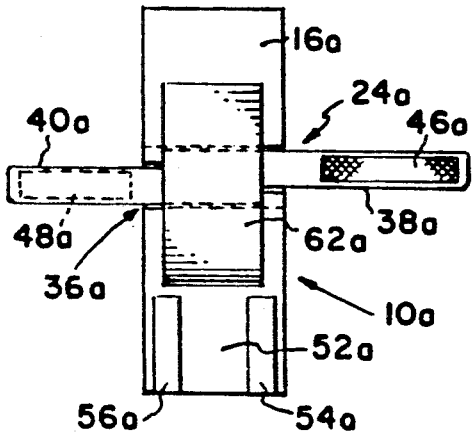
FIG. 3 is a view similar to FIG. 1 but illustrating a therapeutic exercise shoe for the left foot.

A portable, therapeutic foot exercise shoe constructed according to the present invention, generally designated 10, includes a sole, generally designated 12, and mechanism, generally designated 14, for coupling the sole 12 to a human foot schematically designated F.

The sole 12 includes a pair of upper and lower planar layers 16, 18 which are bonded together via a suitable layer 20 of adhesive. The planar layers 16 and 18 may suitably comprise rigid masonite material which remains substantially planar when downward force is exerted thereon by the user.

The lower surface 22 of the lower sole layer 18 lies in a horizontal plane, is uninterrupted and highly polished to be extremely smooth and enhance sliding movement in a to-and-fro path, represented by the arrows 25, on an underlying strip carpet, generally designated C.

Figure 1:
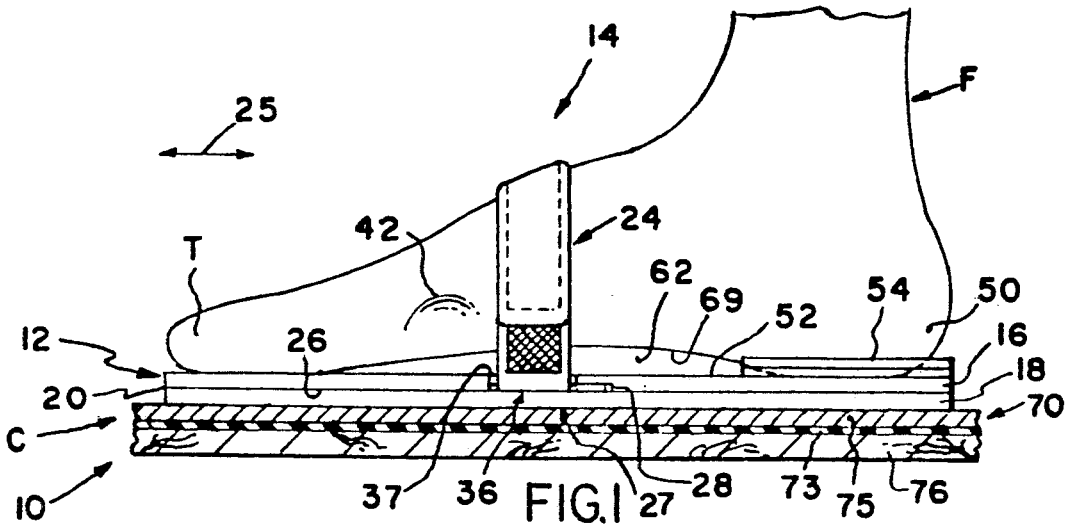
FIG. 1 is a side elevational view of therapeutic foot exercise shoe constructed according to the present invention mounted on the underside of a user's right foot.

The coupling apparatus 14 includes a strap, generally designated 24 which may suitably comprise leather. The underside 26 of the midportion 27 of the upper board 16 includes a tranverse slot 28 for receiving a central or intermediate portion 36 of the strap 24. The strap 24 is of such length that the inner and outer strap ends 38 and 40 overlap each other when placed over the top of the foot F as illustrated in FIG. 1. The inner free strap end portion 38 is coupled to a front edge portion of the intermediate portion 36 and is forwardly offset relative to the strap end 40 so as to pass just immediately behind the boney prominence 42, normally located just rearward of the big toe T of the human foot F. The outer free strap end 40 is coupled to a rear edge portion of the intermediate portion 36 and is displaced rearwardly, relative to the strap end 38 so as to pass just behind the small toe of the user's foot F. The inner and outer sides 47 and 49 of free end strap portions 38 and 40, respectively, mount confronting VELCRO fastener strips 46 and 48, respectively, which include mating hook and loop surfaces that detachably secure the strap portions 38 and 40 together when positioned in abutting relation as illustrated in FIG. 1.

The left lateral edge portion 30 of the upper sole layer 16 includes a notch 37 communicating with the slot 28 to receive the strap 38 whereas the right lateral edge portion 39 of the upper strip 16 includes a slightly rearwardly disposed notch 41 communicating with the slot 28 to receive the strap portion 40. It is noted that the notch portions 37 is forwardly offset relative to the notch portion 41.

To inhibit relative lateral movement of the users heel 50 of the foot F and the upper surface 52 of the upper sole layer 16, a pair of longitudinally extending, laterally spaced apart upstanding heel strips 54 and 56 are mounted on the laterally outer edge rearward heel portions of the upper surface 52. The strips 54, 56 are raised relative to upper sole surface 52 and have a higher coefficient of friction than the coefficient of friction of surface 52. The strips 54, 56 may suitably comprise velcro strips.

Figure 5:
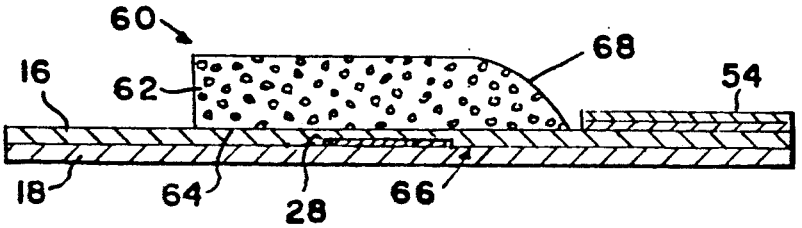
FIG. 5 is a sectional side view taken along the line 5—5 of FIG. 2.

To preclude relative longitudinal movement of the foot F and the upper sole surface 52, an in-step supporting member, generally designated 60, is provided and comprises a block 62 of compressible foam. The foam block 62 includes a bottom surface 64 which is cemented or otherwise suitably mounted to the intermediate portion 66 of the upper sole strip 16. The rearward portion 68 of the block 60 is tapered rearwardly downwardly as illustrated in FIG. 5 to accommodate the normal curvature 69 underside of the foot. The sponge material of block 60 will bear against the underside of the users foot F and inhibit relative longitudinal movement of the foot F and the sole 12. The coefficient of friction of sponge block 60 is higher than the coefficient of friction of upper board surface 52.

The apparatus constructed according to the present invention includes a strip 70 of so-called "rubberized" carpet material which is placed on an underlying floor 76. The shoes 10 are slidably moveable on the strip 70. The carpet strip 70 includes a lower layer 73 of rubber and an overlying layer 75 of carpet fabric secured to the lower layer 73. The rubber layer 73 will preclude sliding movement of the strip 70 on an underlying floor 76.

Figure 2:
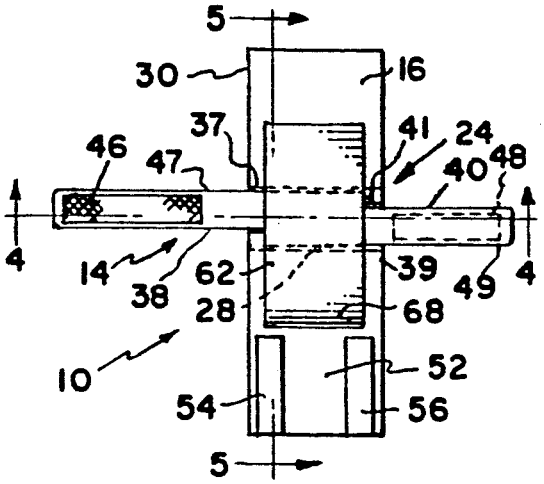
FIG. 2 is a reduced top plan view of the shoe illustrated in FIG. 1 but illustrating the foot coupling strap in a decoupled position.

The left shoe illustrated in FIG. 3 is generally similar to the right shoe illustrated in FIG. 2 and generally similar parts are identified with similar numerals followed by the letter '*a*' subscript. The strap 24*a* differs in that the inner strap 38*a* is toward the right as viewed in FIG. 3 and the outer strap end strap portion 40*a* is to the left as illustrated in FIG. 3.

THE OPERATION

Figure 4:
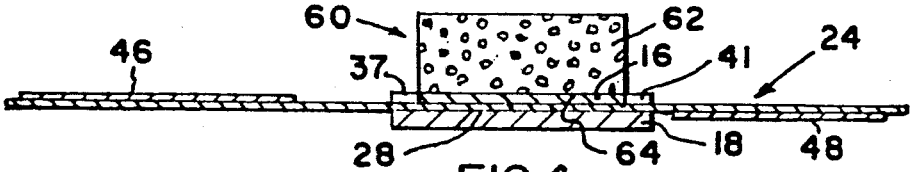
FIG. 4 is a front sectional view, taken along the line 4—4 of FIG. 2.

The user, who will normally be in a sitting position, will place his foot F on the upper surface 52 of the sole 10 with the heel 50 between the strips 56 and the sponge block 60 compressed from the position illustrated in FIGS. 4 and 5 to that illustrated in FIG. 1. The user then will couple the straps 38 and 40 together along the top side of the foot F as illustrated in FIG. 1.

The user's foot will then be placed on the carpet strip C and slid in a longitudinal to-and-fro path represented by the arrows 25. The lower, highly polished smooth surface 22 will slide back and forth easily on the surface 72 so that the user can easily exercise the foot.

The therapeutic exercise shoe can also be utilized by a bed-ridden patient lying on his back.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. In combination:

a portable, planar support member having an upper slide surface; and a therapeutic foot and leg exercise device comprising:

longitudinally extending, rigid planar slide means for sliding in a to-and-fro longitudinal path of travel on said upper slide surface of said support member; and means for coupling said slide means to the underside of a foot;

said slide means including a stiff sole comprising upper and lower planar layers of firm material disposed in confronting relation and means for securing said upper and lower planar layers together; said upper layer having an upper foot support surface and said lower layer having a smooth uninterrupted, planar bottom surface for enhancing said to-and-fro sliding movement on said upper slide surface of said support member.

2. The exercise device set forth in claim 1 wherein means is provided on the upper surface of said sole to inhibit lateral movement of said foot on said sole as said sole is propelled in said to-and-fro path.

3. The exercise device set forth in claim 2 wherein said means for inhibiting lateral movement comprises longitudinally extending strips mounted on laterally opposite sides of the rear upper portion of said sole.

4. The exercise device set forth in claim 2 including means mounted on said upper surface interjacent the ends thereof for bearing against the underside of said foot to inhibit relative longitudinal movement of said foot and said shoe as said shoe is longitudinally mounted in said to-and-fro path.

5. The exercise device set forth in claim 1 including instep support means mounted on said upper surface.

6. The exercise device set forth in claim 5 wherein said instep support means comprises material having a coefficient of friction which is higher than the coefficient of friction of the upper surface of said sole.

7. The exercise device set forth in claim 5 wherein said instep support means comprises a block of compressible foam.

8. The exercise device set forth in claim 7 wherein said block of compressible foam includes a forward end and a trailing end, said trailing end having a downwardly, rearwardly inclined support surface.

9. The exercise device set forth in claim 1 wherein at least one of said layers of said sole includes a transverse slot extending the width thereof for receiving said coupling means.

10. A therapeutic foot and leg exercise device comprising:

longitudinally extending, rigid planar slide means for sliding in a to-and-fro longitudinal path of travel on an underlying support member; and means for coupling said slide means to the underside of a foot;

said slide means including a stiff sole having an upper foot support surface and a smooth uninterrupted, planar bottom surface for enhancing said to-and-fro sliding movement;

said sole including a transverse slot between said upper and lower surfaces extending the full width of said sole between the ends of said sole;

said coupling means being received by said slot and comprising a strap including an intermediate portion, having a predetermined front-to-rear width, and received by said slot and first and second end portions, having a front-to-rear width substantially less than said predetermined width of said intermediate portion, fixed to front and rear longitudinally spaced portions, respectively, of said intermediate portion at first and second junctions respectively, and each of said first and second end portions having a free terminal end foot securing portion for overlying said foot, and means on said free terminal end portions for detachably coupling said free end portions together;

said first junction of said first end portion and said intermediate portion being forwardly offset relative to said second junction of said second end portion and said intermediate portion.

11. The exercise device set forth in claim 2 including a pair of laterally spaced apart, longitudinally extending, upstanding strip means mounted on a rear end portion of said upper surface for inhibiting relative lateral movement of said sole and said foot as said sole is propelled on said to-and-fro path.

12. The exercise device set forth in claim 11 including instep support means mounted on said upper surface between the longitudinal ends thereof and including a block of compressible foam for bearing against the underside of the foot to inhibit relative longitudinal movement of said foot and said sole as said sole is slidingly propelled in said to-and-fro path of travel.

13. The exercise device set forth in claim 12 wherein said support member comprises a carpet strip on which said sole slides in said to-and-fro path.

* * * * *